US005749646A

United States Patent [19]

Brittell

[11] Patent Number: 5,749,646

[45] Date of Patent: May 12, 1998

[54] SPECIAL EFFECT LAMPS

[76] Inventor: Gerald A. Brittell, 2849 Coulter Rd., Whiteoak, Pa. 15131

[21] Appl. No.: 339,922

[22] Filed: Dec. 15, 1994

Related U.S. Application Data

[63] Continuation-in-part of Ser. No. 990,533, Dec. 14, 1992, abandoned, which is a continuation-in-part of Ser. No. 822,596, Jan. 17, 1992, abandoned.

[51] Int. Cl.[6] ..... F21V 9/10

[52] U.S. Cl. ..... 362/231; 362/240; 362/806

[58] Field of Search ..... 362/227, 231, 362/240, 252, 293, 311, 458, 806, 811

[56] References Cited

U.S. PATENT DOCUMENTS

| | | | |
|---|---|---|---|
| 1,198,065 | 9/1916 | Schempmoes | 362/227 |
| 3,324,289 | 6/1967 | Cirko | 362/251 |
| 3,388,245 | 6/1968 | Larson | 362/212 |
| 3,721,814 | 3/1973 | Ries | 362/251 |
| 3,767,903 | 10/1973 | Dean, III | 362/811 |
| 3,789,211 | 1/1974 | Kramer | 362/231 |
| 3,805,049 | 4/1974 | Frank et al. | 362/811 |
| 4,125,888 | 11/1978 | Tsuchihashi et al. | 362/811 |
| 4,161,021 | 7/1979 | George, Jr. | 362/806 |
| 4,173,038 | 10/1979 | Kiefer | 362/811 |
| 4,668,895 | 5/1987 | Schneiter | 362/811 |

FOREIGN PATENT DOCUMENTS

| | | | |
|---|---|---|---|
| 1291703 | 4/1969 | Germany | 362/235 |

*Primary Examiner*—Ira S. Lazarus
*Assistant Examiner*—Matthew Spark

[57] ABSTRACT

A special effect electrical lamp assembly capable of emitting different colors of light at different times onto a plural number of distinct areas on the lamp or on objects some distance from the lamp. A plural number of colored light generating units, each comprised of clusters of colored lamps of different colors, emit a resultant light which changes color as different lamps are energized one at a time and in combinations, either spontaneously under lamp control, or by manual selection in some embodiments. A wide variety of artistically shaped shades, covers, and reflectors refract the changing colored light producing surprising effects including moving images, change with the music illusions, and actual movement of lamp parts. A multiple color producing light bulb embodiment is installed in multiple color generating unit lamps and can also be inserted into any appropriate common light bulb receptacle. A multiple light bulb holder with a minimal number of components holds and energizes a plural number of light sources. Applications of the present invention include decorative novelty lamps, signs, point of display illuminated products, floodlights, stage lights, holiday decorations, and color therapy lamps.

20 Claims, 9 Drawing Sheets

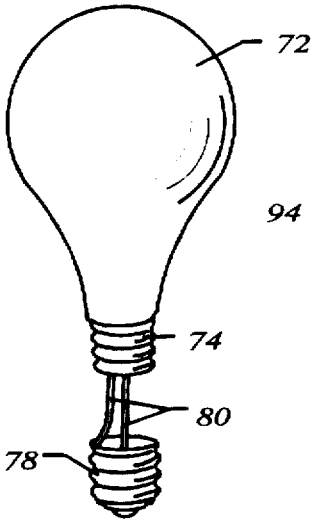
FIG. 10
FIG. 11A
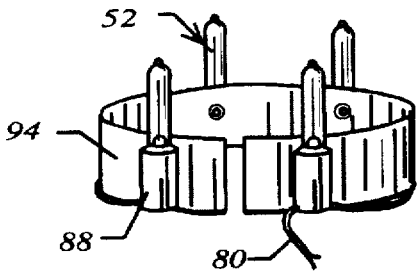
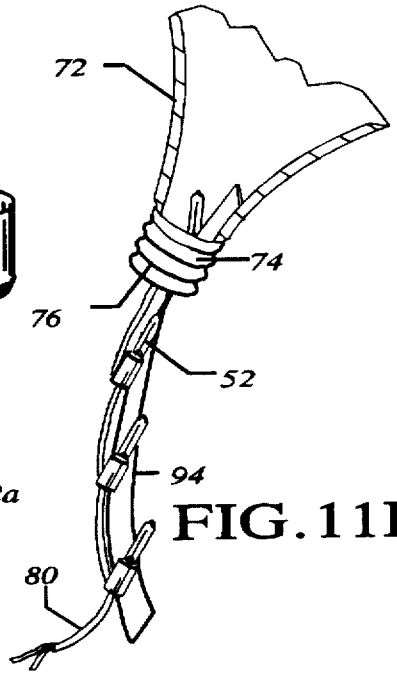
FIG. 11B
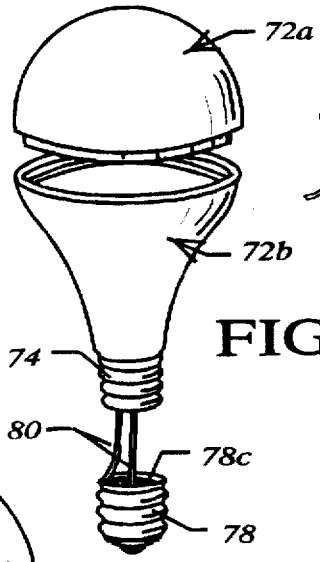
FIG. 12
FIG. 13
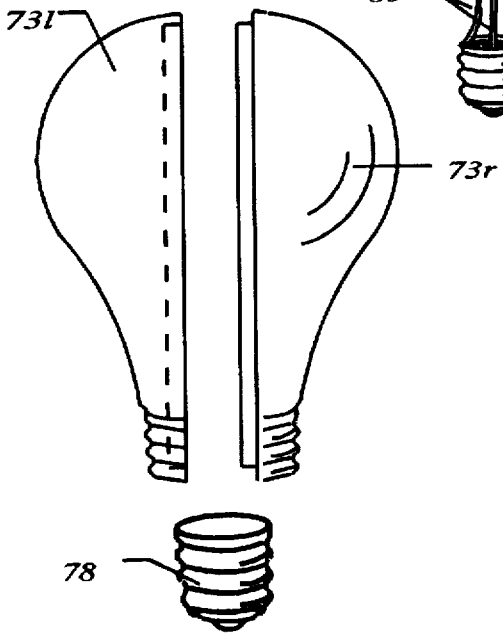
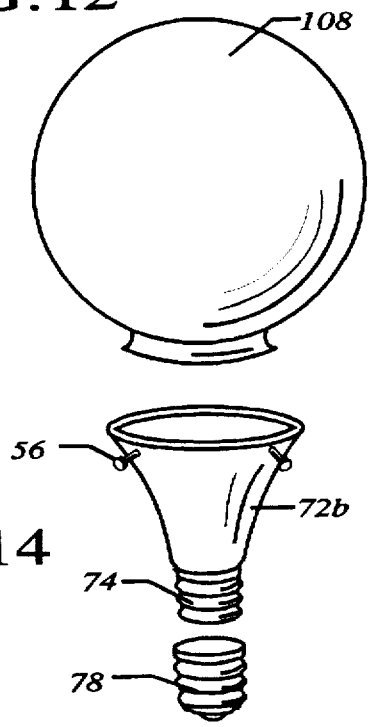
FIG. 14

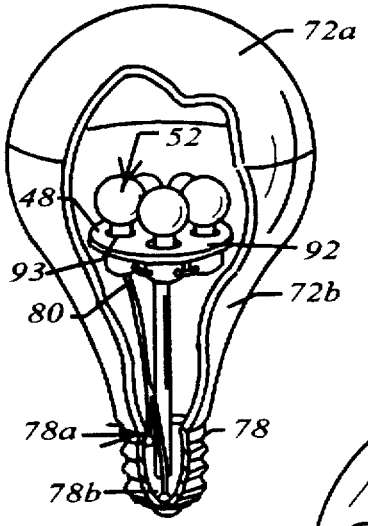
FIG.15
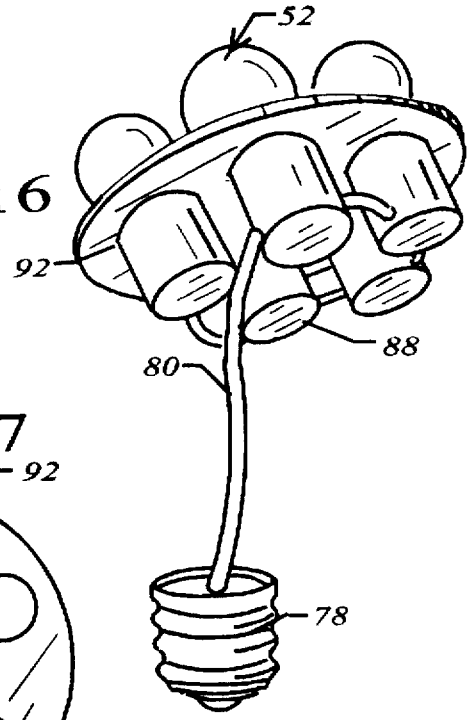
FIG.16
FIG.17
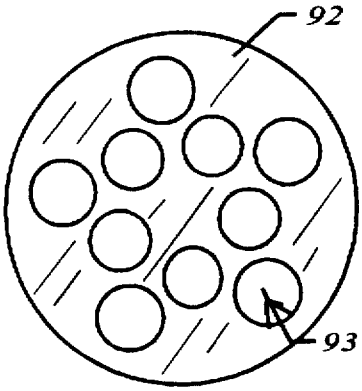
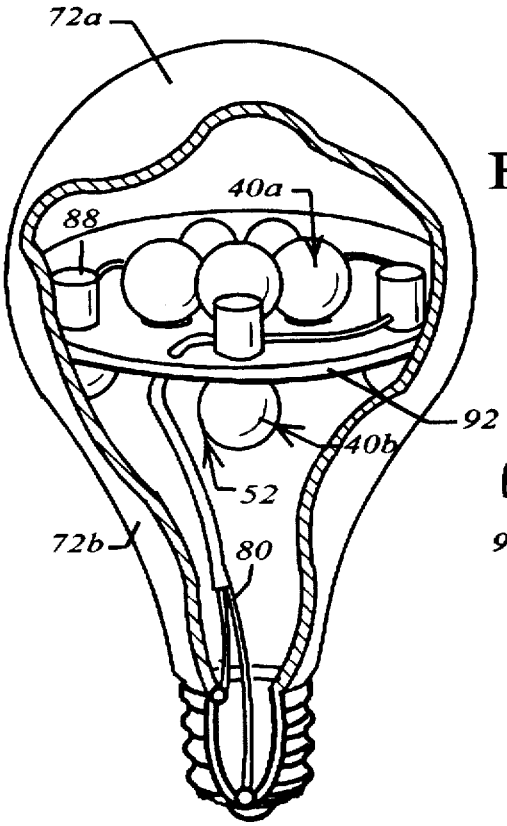
FIG.18
FIG.19B
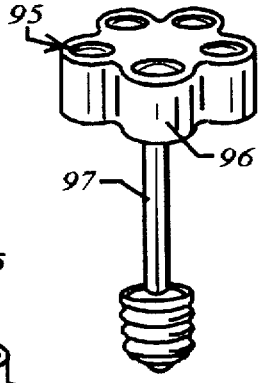
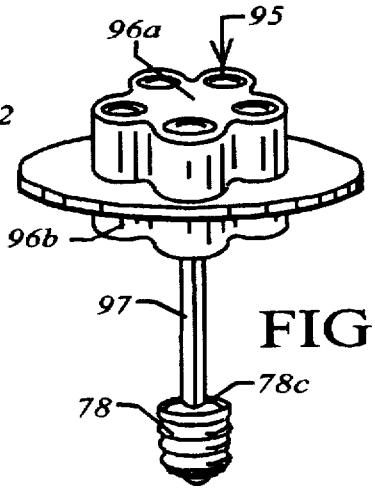
FIG.19A

SPECIAL EFFECT LAMPS

THE SPECIFICATIONS

This is a Continuation-In-Part of CIP application Ser. No. 07/990,533, filed Dec. 14, 1992, itself a Continuation-In-Part of the original application Ser. No. 7/822,596 filed Jan. 7, 1992, both now abandoned.

SUMMARY OF THE INVENTION

This invention relates to electrically lighted lamps, specifically those that produce pleasing optical effects.

When light emitted by a cluster of variously colored light sources, shining singly or more than one at a time together, falls on a neutral colored light diffusing area, the area glows with a resultant monochromatic color. The present invention superimposes at least part of at least one such illumined area in front of a background area also illumined with light emitted from another cluster of variously colored light sources. If the light from each of the colored light emitting clusters is substantially blocked from mixing together by some opaque partitioning material placed between them, the light refracted and reflected from the background area passes by and around the periphery of the foreground light diffusing area, or areas, forming at least two areas of glowing monochromatic light juxtaposed and circumjacent to each other. The color red emitted from a single red light bulb in one cluster shining upon the background light diffusing area, for example, might encircle green, the resultant light emitted from a yellow and a blue light bulb shining together on the superimposed foreground surface.

The present invention also provides that the colored light resolved on each discrete area can change from one hue to another by providing timing means to energize and de-energize different individual light sources at different times, and in some cases, provides that the light sources can sometimes be lighted together in different combinations to mix colors. The timing means in some embodiments also provides that user can select specific desired colors to shine, controlling the length of time they glow and even the type of pulsation. Some lamps offer both the option that the lamp itself spontaneously change the timing and the colors through various internal timing means, and the option to selectively control the timing and the colors by manually operating a multiple function switch.

Conventional "twinkle" type Christmas tree light bulbs, with bimetallic heat responsive switches, which flash with randomly irregular lengths of "on" and "off" states, provide that different bulbs incrementally flash in different combinations of resultant color spontaneously and in unpredictable random order. A unit of five differently colored bulbs flashing independently results in 121 permutations. Ten flashing Christmas tree bulbs, each of a different hue, and assembled into two separated generating units, flashing in all possible combinations will eventually spontaneously produce 14,641 (121×121) combinations and permutations of shade, hue and position. These events, along with the innumerable timing changes, occur in indeterminate and unpredictable order. Using irregularly flashing bulbs, occasionally there will be short periods when none of the lamps in a color generating unit are illuminated. Sometimes all the generating units will be dark for moments, adding to the pleasing optical and rhythmical effects.

Besides randomly flashing light bulbs with self contained circuit breakers, many other electrical timing means can be utilized to provide that colors change and are mixed both spontaneously and/or under the manual control of the user.

Capacitors, digital semiconductor randomizers and timers, and a large variety of state of the art integrated circuits and switches, both analog and digital can be used to provide options for control of the pulsation and the selection and mixing of desired colors. Two simple analog electrical circuit diagrams are shown as examples of switching controls, one for a two unit color generating lamp and another for a single unit multiple color producing light bulb.

Innumerable timing permutations are possible. A flashing clear light may be created by simultaneously pulsating red, green, and blue lamps in one or more units. Some lamps may remain in a steady "on" state while others are caused to pulsate, effecting a particular range of shades of pulsing color to be emitted. One unit may pulse in a regular manner while another unit may pulse in a regular/irregular manner; that is, some of the lamps within one unit alternate "on" and "off" states with the same lengths of duration for both states, while the lamps of a selected color in another generating unit maintain regular lengths of "on" states but irregular lengths of "off" states. Five colored bulbs can each be made to regularly pulsate at different rates, thereby continuously mixing ever changing resultant colors. Two different colors may be made to alternatively flash from the same generating unit, or from separate generating units. These few examples should suffice to show the asperity of attempting to list all possible combinations and permutations of timing the elements of the present invention can effect using present state-of-the-art electronics, and those yet to be designed.

One color of light viewed on an area surrounded by another color of light is perceived differently than one color of light glowing alone, or two or more areas of colored light standing apart. Aside from the obvious difference in number, qualities such as "contrast" and "harmony" arise by insuring one area is seen in close conjunction with another. When the colors are pulsed for varying lengths of time, sensations of "rhythm" arise from the apparent interaction between the changing colored areas, coincidental as it may or may not be. A blue circle of light surrounded by pink has a different physiological and psychological effect than either of the colored lights glowing alone or the two colors standing apart. When the surrounding pink light changes quickly to green, then to violet, while the more central blue area changes to vibrant red, many different sensations arise as a "warm" color is set against a "cool" color, or a "pale" color against a "deep" color, a "stimulating" color against a "calming" color, or when the combination of adjacent colors harmonize and amplify their optical and subjective effects.

When many changes of color and timing occur in a short span of time on multiple areas on the lamps or are projected on objects some distance from the lamps, there is a high probability that some of these changing events will happen to occur at the same time as other events coincidentally occurring in the environment. This is the true explanation for why the action of the randomly flashing lamps appears to be causally linked to changes that occur in accompanying music and dance motions. The especial and surprising intensity of this illusion and the particular interaction between lighted colored areas which apparently and coincidentally change with music is not achieved by prior art.

The configuration of the elements of the invention allows that a compact apparatus using a minimal number of light sources can be designed and assembled in pleasing forms, some representing familiar objects, including the common light bulb. Placing at least one light affecting member in front of another allows the use of only two generating units with a preferred number of three or more light sources in each unit to cause that one glowing area be seen encompassed by another.

Unusual optical effects such as afterimages, moving images and shadows, and illusions of expansion and contraction are some of the effects produced by these lamps shaped in artistic forms. As shown below, the changing angles of incidence of the light cast from the incrementally pulsed light sources cause colored images and shadows to fall in changing locations. Eyes and mouths can appear to move, wings flap, legs and arms dance, on lamps shaped like animate objects. Actual movement of lamp parts, in some embodiments, is achieved by using the rising convective air warmed by the bulbs within the lamp assembly, as illustrated. Concentric bands of glowing, changing, color are radiated from flower shaped embodiments of this invention.

Using a standard Edison light bulb base, and a translucid envelope concealing several enclosed colored lamps, and means to light individual lamps at different times in varying combinations, a novel multiple color producing light bulb lamp is created. The "globe" envelope may be shaped into any number of artistically designed forms (caricatured animals and people, flowers, etc.) forming unique novelty light bulbs that change colors, apparently in time with music.

The unexpected action of a bulb shaped like the common "light bulb" surprises a viewer when it is turned on. After first glowing clear, or white, like a common light bulb (the primary colors all adding to clear) the bulb begins to flicker pastel colors, then breaks into one deep color after another as the incrementally pulsing lamps concealed within the globe begin to flash on and off. A preferred method of generating the multiple areas of changing color in the disclosed lamps is to use one or more of these multiple color producing light bulb lamps as color generating units. They are easily screwed into supplied sockets and can be removed by the user to replace spent bulbs.

Several possible designs of the multiple color producing light bulb lamp are shown. In the smaller multiple color producing bulbs, the enclosed colored lamps can be inserted through the neck opening before the globe is attached to the electrically conductive base, this operation facilitated by a multi-bulb holder flexible strip that resumes its circular shape after insertion. Some globes are made of two pieces that snap together, and apart, allowing access to the user to change spent lamps. Others are of the throw away type, the envelope sealed to prevent access to the users. The envelopes or globes of these "light bulb" lamps do not need to be evacuated because each of the lamps enclosed within them are operable in the oxygenated atmosphere.

Some models of these "light bulbs" contain a plurality of separated generating units to simultaneously illuminate different areas on a lamp assembly in which they are installed. Other plural unit bulbs cause designed areas on the surface of the translucid envelope of the bulb itself to glow. Some bulb globes are transparent or have a transparent part to allow complete passage of the generated light onto a surface outside the bulb housing. The projection of the colored light can be enhanced by various refracting lens formed into the surface of the globe envelope. By the use of different combinations and degrees of light affecting materials on the globe, and differently shaped and differently positioned light blocking partitions, an innumerable variety of patterns can be projected on the surface of the globe or radiated outward from the bulb. Incrementally pulsing light sources occupying various positions within the bulb cause an image or shadow to appear to jump about or move on a wall, a lamp enclosure, or on the surface of the novelty bulb itself.

Multiple function switches on some of these light bulbs allow the user to select a desired color to shine for a chosen time. Either linear or logic based integrated circuits can be enclosed inside the lamp envelope. Some embodiments of these light bulb lamps can be of the "three-way" type used in prior art three-way receptical sockets in lamps with common three-way switches. For the first time, a single bulb can radiate a wide range of colors, one at a time or changing one after another.

Considering the varied uses to which colored light can be put, it is emphasized that only a few of all possible apparatus embodying the claimed elements can be described. The innumerable combinations of specifications for the elements including size (mini-bulbs to searchlights), type of light sources (neon, fluorescent, LED, incandescent, inert gas lamps, high-intensity projection lamps etc.), different light affecting materials used for shades, reflectors, etc., and the wide variety of possible electrical power specifications precludes an exhaustive description.

A multiple lamp bulb holder unit that can be utilized in a wide number of applications is herein disclosed. The sockets can be configured in a ring, or placed side by side in line; they may be manufactured to hold and power any number of types and sizes of bulbs. Only a ring configuration holding Christmas tree type bulbs is illustrated. Such descriptions do not in any way limit the scope of the invention to the particular examples disclosed.

The members of the lamps herein termed light affecting areas which are used to diffuse the resultant polychromatic light into monochromatic colors, or project the resultant light on objects away from the lamp, may have any variety or mixture of light affecting qualities. Reflecting, partially refracting, or highly reflecting membranes or objects may reflect the light produced by the generating units to the eyes of the viewer of the lamp or upon an object. Light refracting lenses of varying degrees of translucency and transparency or opaque areas and translucent colored areas on a film or object may project a changing colored image onto a screen or the retina of a viewer's eye. A surface on a lamp may be totally opaque in part, translucently colored in other parts, or with an opening through which other light affecting surfaces may be viewed.

The present lamps can be manufactured for use in the home, in commercial establishments such as restaurants and dance clubs, for stage productions of varied type, for flood lighting of window displays, statues and walls, and for signage advertisements and illuminated point-of-sale displays. They can illuminate many translucent models of products, toy lamps, and occasional, holiday decorations and ornaments. The principles can be used in color therapy lamps and meditation goggles. The multiple color producing light bulbs and bulb holders may be screwed into any standard common lamp fixture and covered with state-of-the-art light bulb covers for use indoors and outdoors.

LIST OF ILLUSTRATIONS

FIG. 1 shows an assembly of two separated colored light generating units.

FIG. 2*a* shows a lamp with a shade membrane with an opening, and

FIG. 2*b*, the color pattern that it forms.

FIGS. 3*a* and 3*b* show a lamp with a housing member and a translucent membrane on its front.

FIGS. 4*a* and 4*b* show an open configuration with a reflecting surface placed in front of another reflective surface which generates three discrete areas of changing color.

FIGS. 5*a* and 5*b* show a closed configuration with a light pervious surrounding membrane upon which two glowing areas of changing color are created.

FIGS. 6*a* and 6*b* show a configuration with a partially surrounding reflective shade and the bands of color radiated onto both the reflective shade and the superimposed surrounding light affecting membrane.

FIGS. 7*a* and 7*b* are diagrams of a multiple color producing light bulb lamp and the changing multiple colored pattern created on its globe surface.

FIG. 8*a* shows the use of two single unit light bulbs in a lamp;

FIG. 8*b* a frontal view and the color pattern produced.

FIG. 10 shows a single piece outer globe and a state-of-the-art screw-type base.

FIG. 11*a* shows a light bulb holder strip for insertion of smaller bulbs through a globe neck opening shown in FIG. 11*b*.

FIG. 12 and FIG. 13 each show multiple piece globe assemblies.

FIG. 14 shows a globe made with a standard light bulb cover.

FIG. 15 shows a single unit multiple color producing light bulb using state-of-the-art socket holders.

FIG. 16 shows the use of a simple disk with holes that holds the bulbs in place.

FIG. 17 shows a disk with 10 holes.

FIG. 18 shows a double unit light bulb using this disk.

Figure 19C:
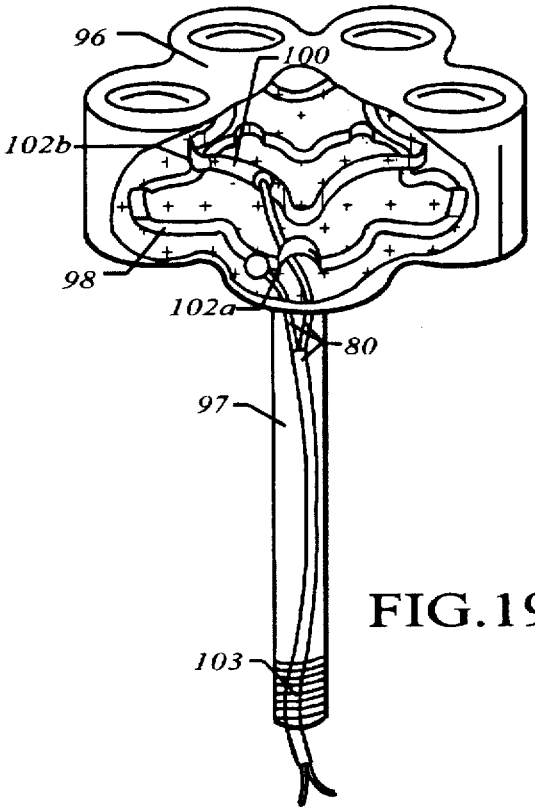

FIG. 19*a* shows a multiple bulb holder for receiving 10 colored bulbs;

FIG. 19*b* a single-unit holder;

FIG. 19*c* a cutaway view.

Figure 19D:
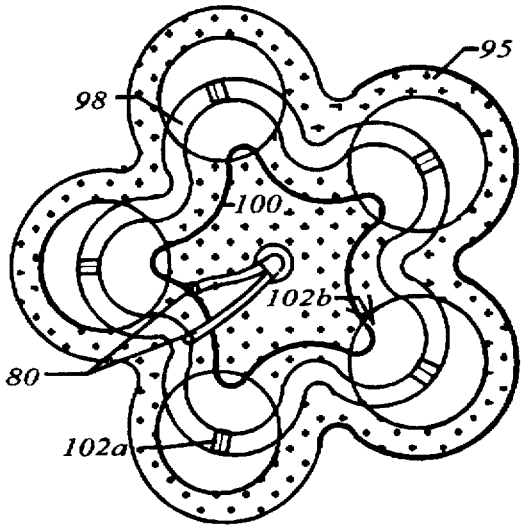

FIG. 19*d* shows a top cutaway view of the receptacle body.

Figure 19E:
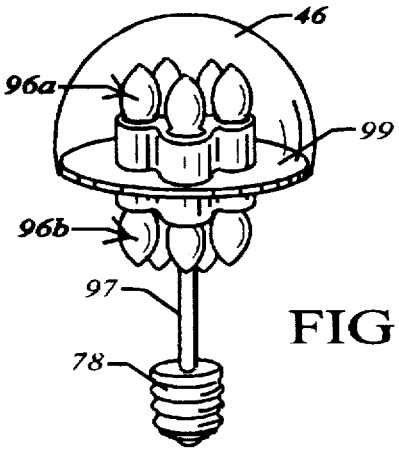

FIG. 19*e* shows a double colored light generating unit multiple bulb holder with an accessory translucent cover.

Figure 19F:
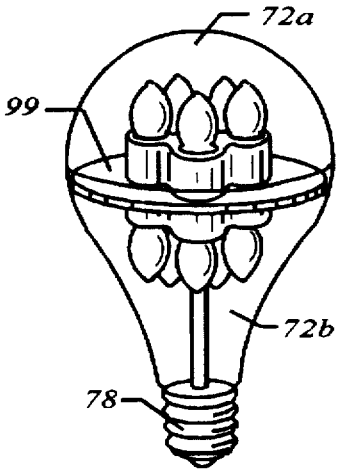

FIG. 19*f* shows a view of a double unit bulb holder with a light blocking partitioning disk.

Figure 20A:
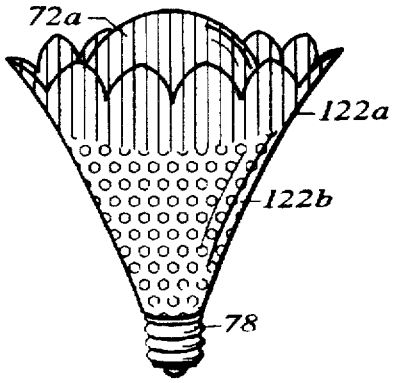
Figure 20B:
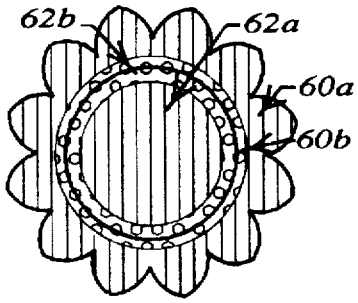
Figure 20C:
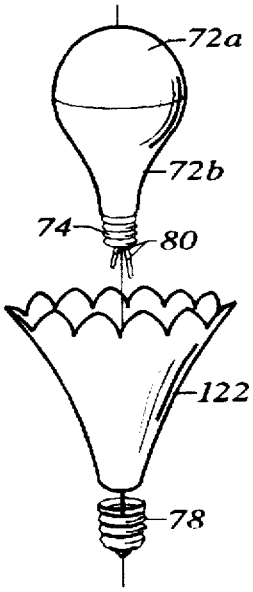

FIG. 20*a* shows a perspective view of a multiple color producing novelty light bulb with an attached sleeve;

FIG. 20*b* a frontal view of this bulb and the resultant color pattern formed by the lamp; and FIG. 20*c* an exploded view.

Figure 21A:
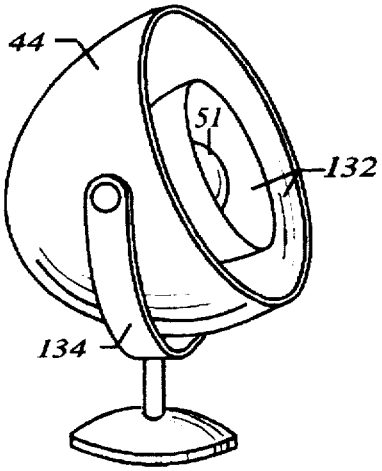
Figure 21B:
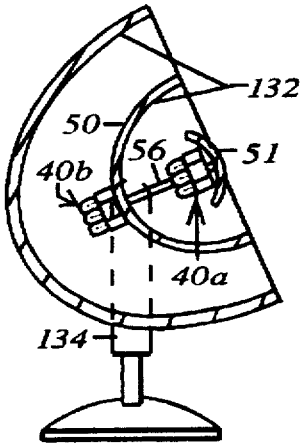
Figure 21C:
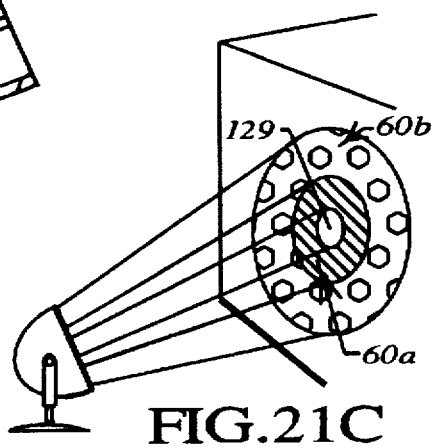

FIGS. 21*a* and 21*b* show a colored-light projecting lamp;

FIG. 21*c* the colored light pattern it casts on a wall.

Figure 22A:
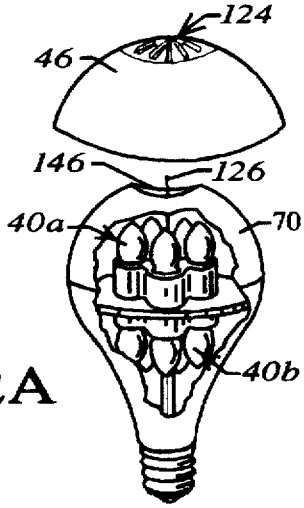
Figure 22B:
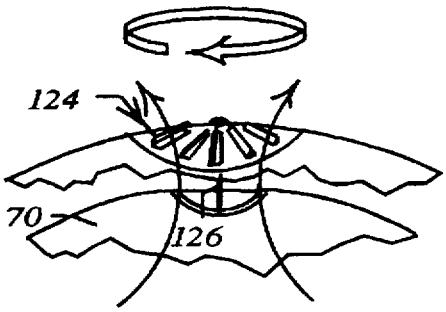

FIGS. 22*a* and 22*b* show a thermal convection apparatus for providing movement of lamp parts.

Figure 23A:
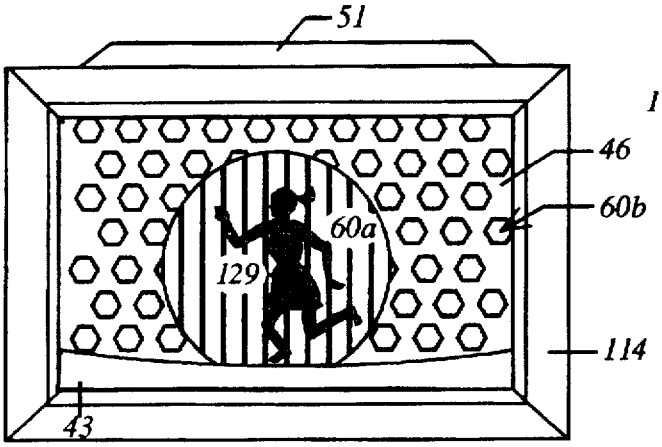
Figure 23B:
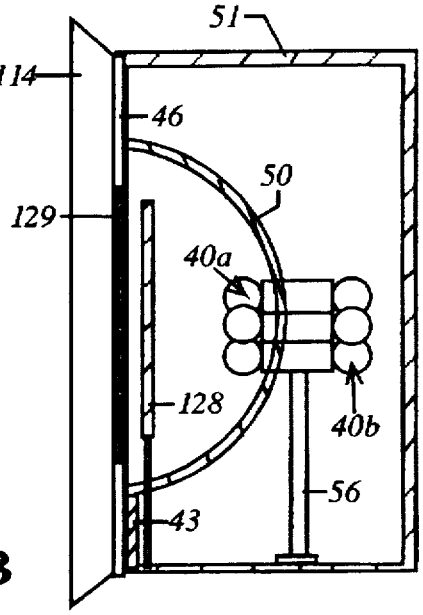

FIG. 23*a* illustrates a method used to cast shadowed images;

FIG. 23*b* a side view.

Figure 24A:
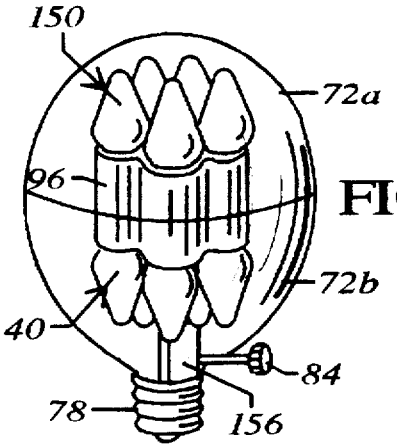

FIG. 24*a* shows a multiple color producing light bulb with a standard multiple function switch providing several lighting options.

Figure 24B:
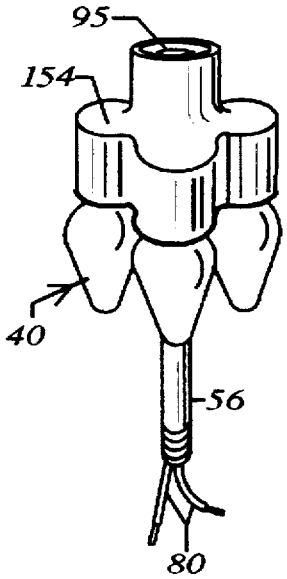

FIG. 24*b* shows a multiple bulb holder with a light bulb receptacle socket.

Figure 24C:
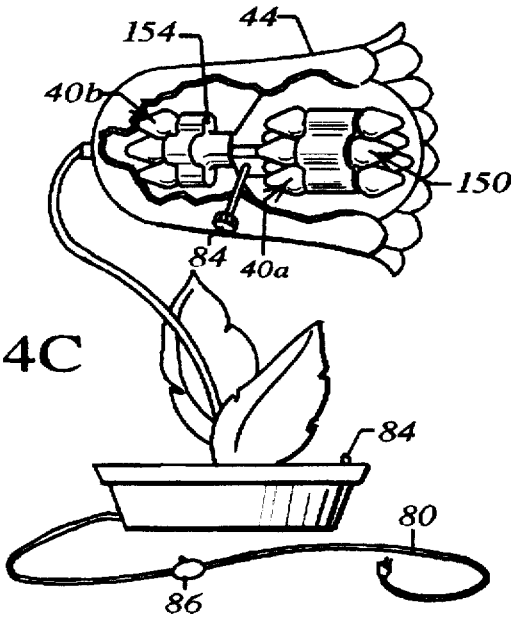

FIG. 24*c* shows a flower lamp with apparatus which provides several options to generate many different colors at different times.

Figure 25:
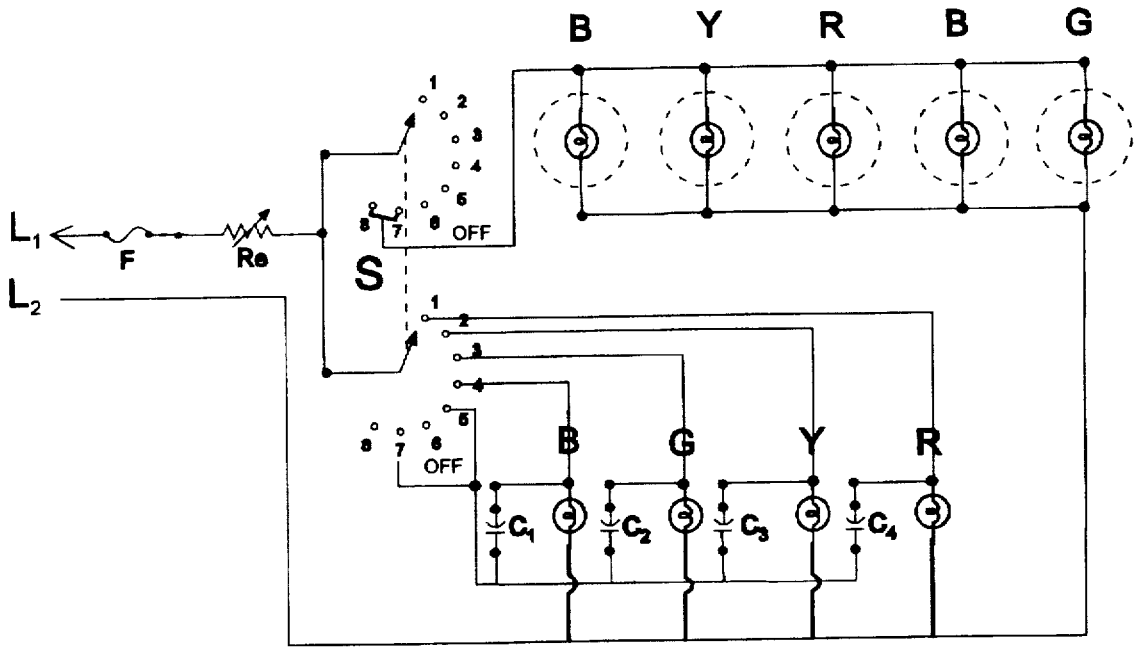

FIG. 25 is a schematic diagram showing an example of a control circuit for a two color generating unit lamp.

Figure 26:
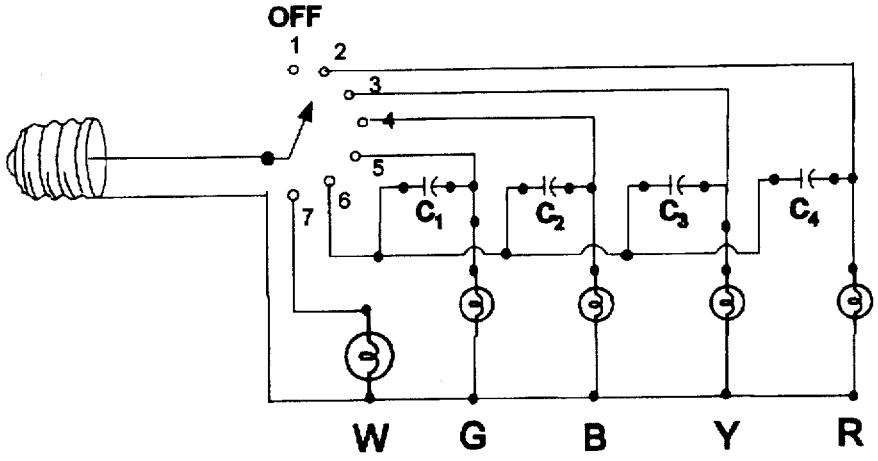

FIG. 26 is a schematic diagram of an example of a circuit for a multiple color producing light bulb with a multifunction switch allowing the user to chose the emitted color.

BASIC CONFIGURATIONS

Figure 1:
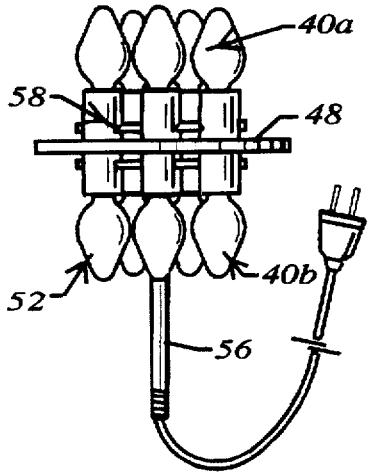

The elements common to all embodiments of this invention are shown in the schematic FIGS. 1 through 8*b*. Each of these figures pictures in a generic way a different basic configuration of the elements. The shapes of the covers, shades and envelopes are only illustrative and can assume any artistic form. While most of the drawings show the use of randomly pulsing Christmas tree type light sources, the present invention is not limited to this type of light sources. FIG. 1 shows a preferred apparatus used to generate continually changing colored light. It pictures in this case, two units 40*a*, 40*b* of independently pulsing colored bulbs 52, four to six in number (red, yellow, green, and blue, or these four colors plus duplicates or other hues) being the preferred number of C-7 Twinkle type Christmas bulbs held together in a cluster, herein termed a colored light generating unit. Lamp-part holding means 56 hold the individual bulbs together and attaches them to the rest of the lamp, electrical means and 82, respectively provide an electrical circuit to each bulb and to the outside energy source of the lamp. The light source timing means is, in this case, heat responsive bimetallic switches contained within each light bulb which intermittently pulse each colored bulb in the lamp, independently of any other. When energized, these light generating units 40*a*, 40*b* emit two randomly changing sets of resultant light as the individual bulbs within them flash "on" or "off", each state continuing for irregularly changing periods of time. The light from one light generating unit is separated from the other by means of an opaque member forming a light blocking partition 48 between them.

Figure 2A:
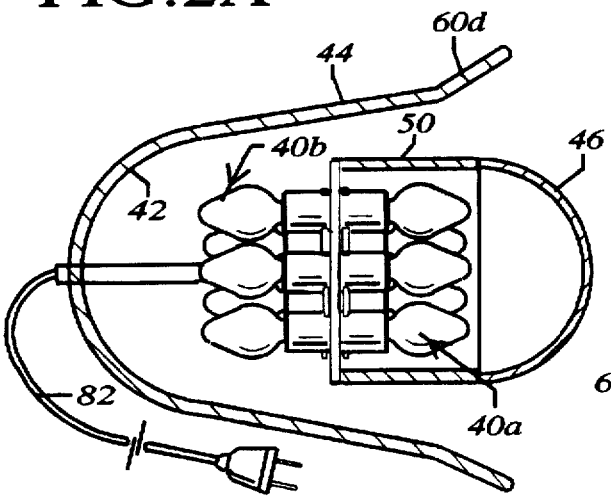
Figure 2B:
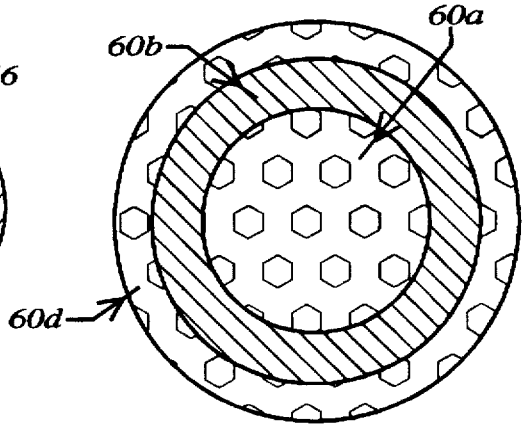

In FIG. 2*a*, the resultant light from one generating unit 40*b* is reflected off a reflective surface 42 which may or may not be completely opaque, and the blended resultant light from the other light generating unit 40*a* simultaneously colors a light affecting translucent area 46 with another changing sequence of colors. The light blocking and reflecting partition 50 divides and directs the resultant light of the frontally placed light generating unit 40*a* through the translucent member 46. The translucent membrane serves to conceal the view of the flashing colored bulbs behind it and diffuses the resultant light creating a monochromatic color changing to another monochromatic color. In FIG. 2*b*, the result is glowing areas of color, 60*a*, 60*b*, each hue changing to another, circumjacent to each other. Yet another band of changing color 60*d* is formed on the reflective surface, angled back from the sides of the reflective shade forming a variently positioned type of light blocking means allowing only the discrete diffused light passing through the central translucent member to fall upon it.

Figure 3A:
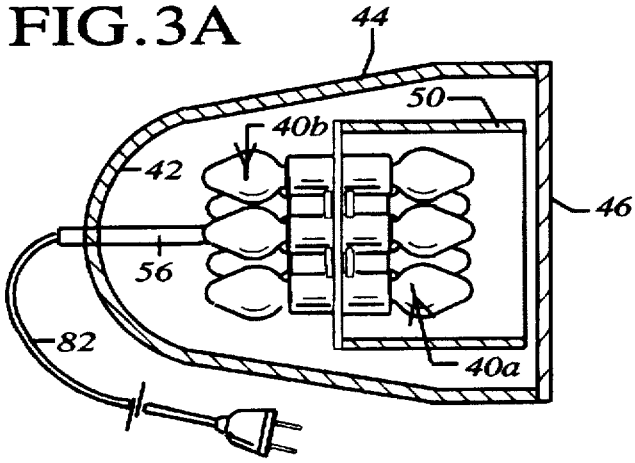
Figure 3B:
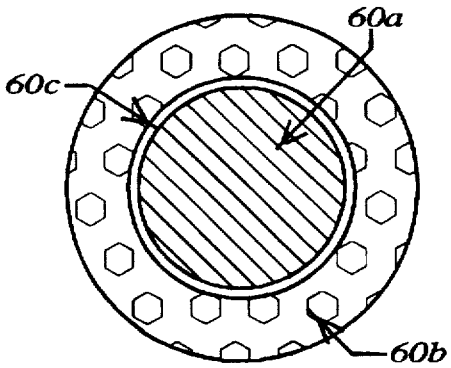
Figure 4A:
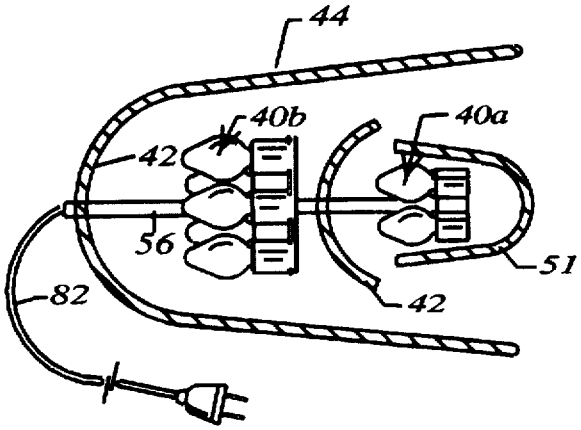
Figure 4B:
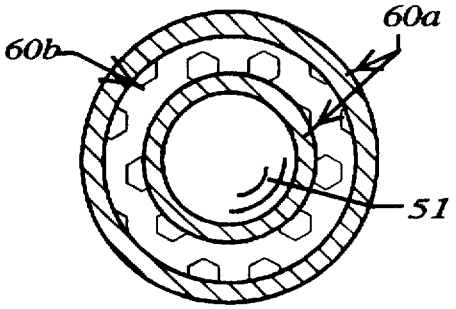

In FIG. 3*a*, showing a housing member with a translucent area type lamp, the resultant light from both generating units 40*a*, 40*b* is directed onto the translucent screen 46 covering the entire front of this example, producing two different glowing areas 60*a*, 60*b* of color, each irregularly changing hue in random order. The resultant light from the rear generating unit 40*b* is reflected off the partially surrounding reflective surface 42 and onto the front translucent screen 46 as is the resultant light from generating unit 40*a* surrounded by an opaque, cup-shaped light blocking partition 50. When the sides of a light blocking partition extend substantially but not completely to the light affecting member upon which the resultant light is projected, as shown in FIG. 3*b*, an area 60*c* of blended light from the two light generating units is formed on the light affecting member (any material with a class of light affecting properties being transparent, translucent, opaque, refracting, reflecting, and/or any combination or degree of any of these). FIGS. 4*a* and 4*b* illustrate the use of a second reflective surface 42 positioned in front of the partially surrounding reflective shade 44 in place of a translucent member as in FIGS. 2*a* and 2*b*. Here, the frontally placed light generating unit 40*a* is made to shine its resultant light back onto this reflective surface 42, the direct view of the flashing bulbs hidden by an opaque covering 51. When seen from the front, as shown in FIG. 4*b*, this lamp configuration also results in several concentric bands of changing colors 60*a*, 60*b*, 60*d*, surrounding the opaque center 51. Even this opaque center area is made to glow with a different changing set of blended colors reflected from the reflective sides 44 if the opaque cover 51 is coated with a colored light diffusing material on its exterior surface.

Figure 5A:
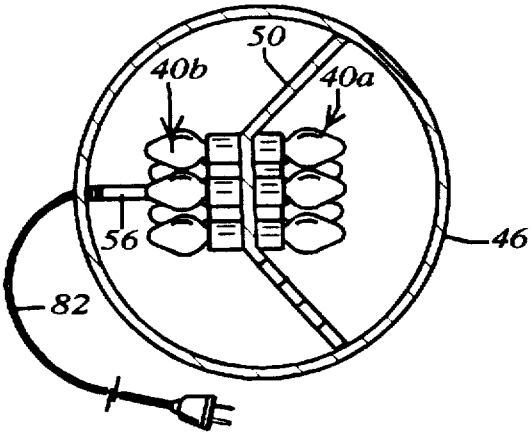
Figure 5B:
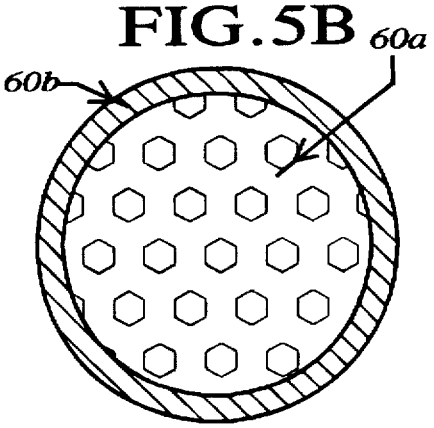

FIG. 5*a* shows another configuration where both light generating units 40*a*, 40*b* are completely enveloped within a light pervious translucent surface 46, the resultant light separated by a light blocking opaque partition 50. When the light from each of the generating units 40*a*, 40*b* is diffused through the translucent surface 46, the translucent surface 46 itself glows with two discrete areas of color 62*a*, 62*b*, FIG. 5*b*. With the use of artfully shaped envelopes with either opaque, transparent, or colored transparent images on the surrounding surface, many different animated lamps can be made.

Figure 6A:
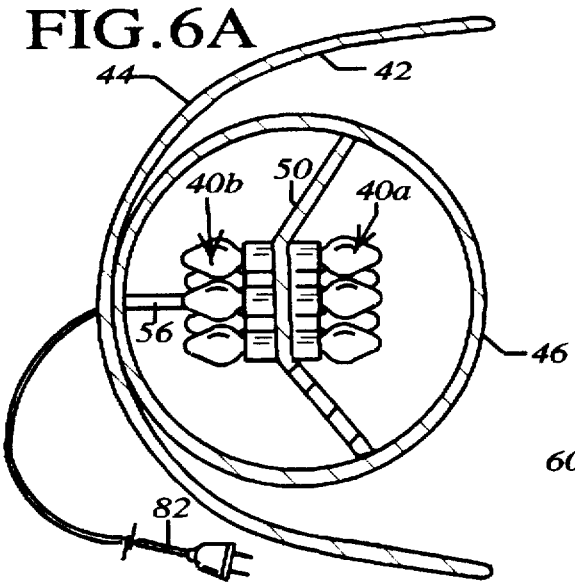
Figure 6B:
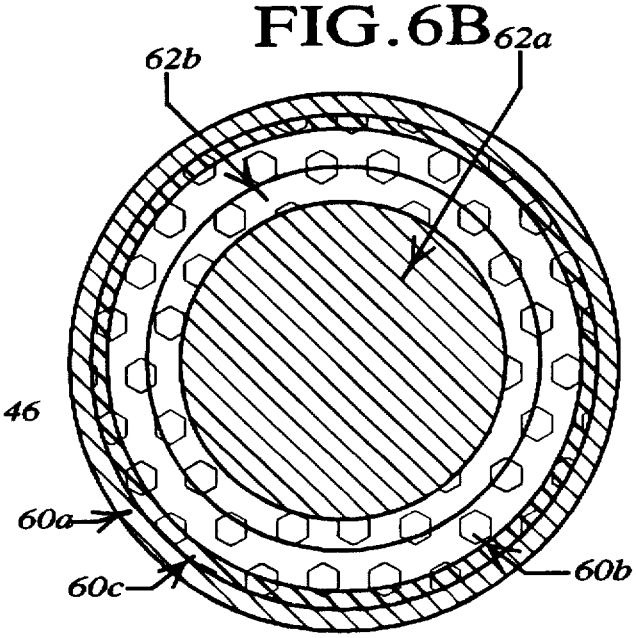

When a surrounding translucent surface 46 is in turn attached to a partially surrounding diffusing/reflecting shade 44, as in FIG. 6*a*, the colored light radiated through the surrounding membrane 46 passes onto the reflective surface 42 and creates two more discrete areas of color on that reflective surface as well forming a total of four areas 60*a*, 60*b*, 62*a*, 62*b* of monochromatic changing colors and a subtle blending of the colors in a narrow band 60*c* between the two areas 60*a*, 60*b* on the reflective surface.

Figure 7A:
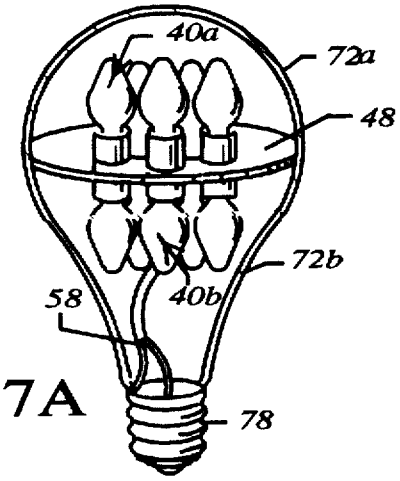
Figure 7B:
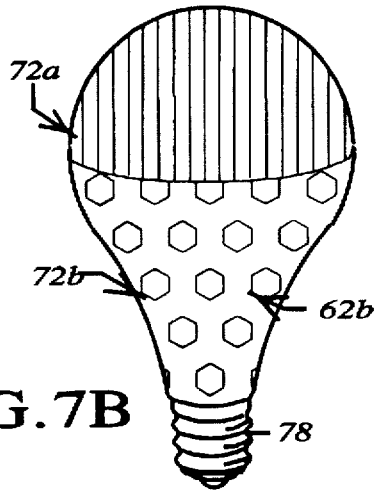

FIG. 7*a* shows a generic view of a light bulb shaped configuration of the primary elements, a light bulb shaped globe of two parts 72*a*, 72*b* connected to an electrically conductive screw base 78. Enclosed colored lamps are contained within the globe of the larger multiple color producing light bulb having the outer appearance of a common light bulb. Such multiple color producing bulbs are utilized in the same manner as common bulbs by screwing them into a state-of-the-art light bulb receptacle. As shown in FIG. 7*b*, the outer globe, when made translucent, takes on two colors 62*a*, 62*b* from the separated generating units within, both changing hues randomly in this case. When the top section 72*a* and the neck section 72*b* are made transparent, the maximum amount of light is passed on through the globe. A reflective or light diffusing surround or "shade" within which these bulbs are enveloped will then take on the colors emitted through the transparent globe and form plural areas of monochromatic changing colors on its surfaces as the individual light sources intermittently pulse one at a time, and in combination at other times. Occasionally, it will happen that none of the light sources in one or both of the colored generating units will be powered for short periods of time, adding black to the spectrum of changing hues.

Figure 8A:
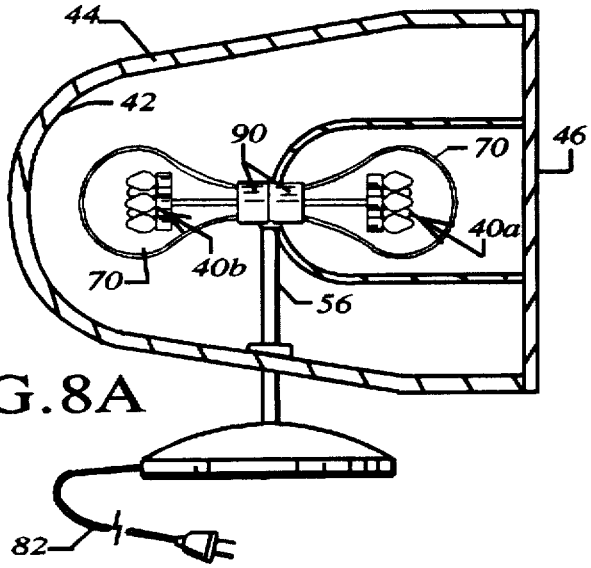
Figure 8B:
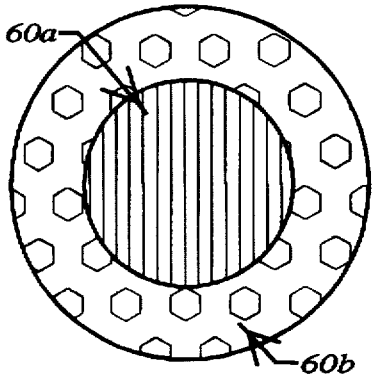

The diagram FIG. 8*a* shows an example using two single unit multiple color producing light bulbs 70 as colored light generating units 40*a*, 40*b* for a special effect lamp. Each bulb 70 contains a single colored light generating unit of pulsing colored bulbs. In this example the front of the lamp is covered with a flat translucent surface 46 and the separating partition 50 extends entirely to the translucent surface forming two discrete areas 60*a*, 60*b* of color, as seen in FIG. 8*b*, with no blended area between. This type of lamp using the color producing light bulbs as generating units also provides mating state-of-the-art light bulb receptacles 90, as seen in FIG. 8*a*, into which the multiple color producing light bulbs can be screwed and powered.

The Multiple Color Producing Light Bulb

The multiple color producing light bulbs are used in many of the special effects lamps as the preferred colored light generating units within the lamps. Some of these bulbs can also be used alone by installing them in any appropriate common light bulb socket.

Figure 9:
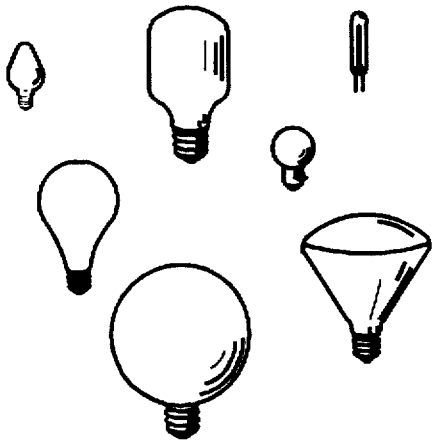
FIG. 9 shows examples of state-of-the-art globe shapes and electrically conductive bases commonly termed "light bulbs".

FIG. 9 shows several shapes of globes and electrical bases that are included in the common idea of "light bulb". The multiple color producing light bulbs can be of any size and shape, powered by either Alternating or Direct Current, and the enclosed smaller colored lamps may be of any wattage and voltage according to the use to be made of the bulbs. For purposes of area illumination, floodlights and stagelights, the enclosed lamps can be of high intensity, and for many ornamental and novelty lamps, small voltage Direct Current operated bulbs of many types may be used.

The mechanism to pulse each enclosed lamp may be contained within the enclosed lamps as in the case of state-of-the-art Christmas tree bulbs with heat responsive circuit breakers, or other state-of-the-art methods used for pulsation such as capacitors and integrated circuitry. The electrically conductive leads from the holders of the enclosed bulbs contained within the larger bulb are soldered or otherwise made fast to the two electrically insulated poles on the metallic conductive base, and the globe envelope of the bulb adhered or otherwise attached to the top of the conductive base.

FIG. 10 shows a one piece globe 72 made of plastic or glass with molded threads 74 formed on the neck area that screw into the interior cavity of a state-of-the-art screw base 78 helping to secure the globe to the base. The wire leads 80 which connect to the two poles of the electrically conducting screw base 78 are also shown. This single piece globe is used when the flashing colored lamps contained within it are small enough to pass through the neck opening 76 along with the bulb socket holders and wire leads.

FIG. 11*a* shows an example of a bulb holder strip that allows the colored light generating unit to be inserted into the bulb through the neck opening 76. The flashing colored bulbs 52 and their socket-holders 88, in this example using state-of-the-art "mini" Christmas type flashing colored bulbs, Direct Current powered, are fastened to a strip 94 of springy material that springs back to its original contour after being positioned within the globe 72, FIG. 10. FIG. 11*b* shows the strip being inserted (or removed) through the neck opening 76.

The only specification for materials used in this invention is that, where necessary for safety, they be of an electrically non-conductive nature and safe in terms of fire hazard. Where required for safety, holes can be provided in surrounding members for ventilation of heated air. The light affecting properties achieved by state-of-the-art methods and materials used for the multiple color producing light bulb globes should serve to obscure from view the individual glowing filaments of the enclosed illuminated colored lamps unless the color producing bulb or some part of it is itself to be hidden by other light blocking structures. Then part or all of the globe may be made transparent to allow maximum passage of light through its globe FIG. 12 shows a preferred form for a two piece globe that snaps together and apart, providing access to install the enclosed bulbs and upon the option of the producer, provide access to the user to change the enclosed bulbs when they burn out or are "spent". A transparent neck section 72b and a translucent top section 72a may be supplied if only the top of the globe will be in view. The inside of the screw base cavities 78c of any electrically conducting screw bases 78 may optionally be filled with a state-of-the-art insulating liquid material that hardens, thereby preventing the user from touching the screw base in the undesirable event the bulb is taken apart while still powered, and further secures the electrical connection of the wire leads 80.

FIG. 13 shows a two piece globe, a left section 73l and a right section 73r that snaps together lengthwise, the assembled pieces further secured by screwing the molded neck 74 into the inside of a standard screw base 78.

FIG. 14 pictures a light bulb shaped color producing light bulb formed by using a state-of-the-art light bulb cover 108 with a flange, and a specially formed separate neck section 72b that is attached to the translucent light bulb cover by screws 56 as shown here, or by other state-of-the-art methods. This neck section 72b is in turn connected to a standard screw base 78 by the use of a molded threaded area on the bottom of the molded neck piece 74 which itself is screwed into the interior of the screw base 78 and secured with a state-of-the-art adhesive. Many other variations not shown are possible on the construction and shape of the light bulb envelope of this multiple color producing light bulb.

FIG. 15 shows a multiple color producing light bulb containing a single light generating unit made from an assembly of state-of-the-art parts: independently flashing colored Christmas tree light bulbs 52 and socket-holders 88. In this drawing the individual flashing colored bulbs 52 and socket-holders 88 are held in place by a simple disk 92 with holes 93, through which the metallic ends of the bulbs are inserted and screwed into the socket-holders 88 placed beneath the disk 92, thereby securing them as shown in FIG. 16. The state-of-the-art socket holders are connected together in a parallel circuit to common wire leads 80 which make electrical contact with the two separated poles 78a, 78b of the conducting screw base 78, secured by solder or other state-of-the-art electrical connection methods. FIG. 17 shows this disc bulb holder with ten holes 93, made to receive five bulbs placed in one direction, and five others facing the opposite direction.

FIG. 18 shows a double-unit color producing bulb using the same type of simple disk 92 to secure the flashing colored bulbs 52 and socket-holders 88, connected to the inner surface of the two parts of the globe, and serving also to separate the two light generating units 40a and 40b.

Multiple Bulb Holders

FIGS. 19a through 19f illustrate a multiple bulb holder apparatus 95 that facilitates assembly and assures safe and durable utility in many embodiments of this invention, including the multiple color producing light bulbs specified above. FIG. 19a shows a perspective of a double unit holder assembled and ready to receive the individual flashing colored bulbs. FIG. 19b shows a single unit model. The holder receptacle body 96 is formed of a non-conductive and non inflammable state-of-the-art material with an electrically conductive member, in this case a metallic strip 98, embedded below the bottoms of the socket cavity openings and another electrically conductive member herein exampled as a ring strip 100 embedded within the receptacle body contiguous to the threaded sides of the socket cavities, with protrusions bent so that they protrude into the sides of the socket cavity. These contact points are made to make electrical contact with the two poles on standard light bulb bases when they are screwed into the sockets. FIG. 19c is a cutaway view revealing these electrically conducting protruding contacts 102a, 102b in the sides and bottoms of the formed sockets. FIG. 19d shows a blown-up cutaway view of these conductive members 102a, 102b embedded within the receptacle ring except for the protruding contact areas.

FIGS. 19a, *b*, *e*, and *f* show the use of a connecting rod 97, attached to the receptacle ring on one end and the screw base 78 on the other end. The rod 97 receives the electrical conductive wire 80, as seen in FIG. 19c, through its interior. This connecting rod 97, as in FIG. 19c, may optionally provide a threaded end 103 to receive state-of-the-art lamp part nuts for connection to lamp reflectors and supporting bases, and for other state-of-the-art electrical fixtures.

Light receiving translucent surface covers 46, as shown in FIG. 19e, made of various materials with different light affecting properties, and variously shaped light blocking partitions 99, are also made to snap onto modular multiple bulb holder units made in a variety of sizes for different applications, be they multiple color producing light bulbs, flowers, or in whatever embodiment this invention is to be used.

FIGS. 19e and 19f show two examples of possible configurations of which such a modular unit may be comprised. FIG. 19e shows a shaped, hemispherical light affecting translucent surface cover 46 covering one color generating unit 96a with an uncovered bottom generating unit 96b, and divided by an opaque partition 99; FIG. 19f shows both units covered with a two-part bulb shaped globe 72a, 72b.

Optional Standard Equipment

The apparatus for any of the embodiments of the present invention may include other state-of-the-art lamp-part equipment. For example, a number of standard electrically conductive mating bases/receptacles and mating plug/plug receptacles combinations including screw type and plug-in bases and receptacles can be utilized for efficient assembly, safety and maintenance of the lamps. The entire lamp itself may be attached to a male or female part which can be screwed or plugged into or over its counterpart, thereby holding and providing electrical connection to the source of power. At least one of the color generating units can be installed into a supplied receptacle in the lamp in the preferred models allowing easy removal to provide access to the enclosed lamps within the globe. The conducting bases can be of any of the several state-of-the-art types such as the standard automobile bulb type metallic base with a protuberance that turns into a slot in a standard spring-loaded receptacle, the flashlight bulb type light bulb base with a flat conducting flange, any size of the standard "Edison type" electrically conductive screw bases, prong and slot plugs, or bases newly designed to meet the requirements of a particular application.

A lamp socket on an independent electrical circuit connected to a switch, single or multiple poled, may be provided for the optional use of a standard clear or white bulb in any of these lamps when desired. This permits the lamp to be used for standard illumination purposes as well as for colored special effects.

An alternative way to provide a common clear light with some of the embodiments of this invention is to insert in the circuitry of the lamp a simple plural-setting, or infinitely-variable setting, state-of-the-art dimmer. By causing all the individual flashing colored bulbs to remain in an "on" state, their light is added together to form "clear" or "white" when the proper colored light sources are used (i.e., red, green, and blue). This is achieved simply by lowering the current below the threshold point required for the circuits to be broken by the flashers. Such a dimmer can also be used to regulate the speed and intensity of the flashing colors. Higher settings of the dimmer cause heat responsive flashers to flash for shorter periods of time and more often.

Some light sources such as neon and other inert gases provide their own characteristic colors when they are heated or excited electrically and require no color filters. Incandescent lamps that burn with a clear light can be color filtered. The depths of the colors of the individual colored lamps may be enhanced by further dipping of state-of-the-art lamps in state-of-the-art colored emulsions, or they may be surrounded by flame resistant colored "gels" or other types of color filters.

Flashing bulbs are found in many sizes with a variety of voltage and lumens specifications. New lamps may also be produced which will fill particular requirements for rate of pulsation, size, power, luminosity, durability, cost, and ease of utilization.

Lamps With Added Accouterments

FIGS. 20*a* through 20*c* show a combination of elements comprising a multiple color producing light bulb with a sleeve. When the attached screw-base 78 is installed into a standard lamp with an appropriately mating socket, and power is turned on, the globe 72*a* first glows a white light which also shines through the translucent area of the sleeve 122*b*. Soon the lamp begins to flicker faint shades of pastel as the individual bulbs inside the two generating unit multiple color producing light bulb begin to blink off and on. Then, as seen in FIG. 20*b*, two different changing sets of color 60*a*, 60*b* appear simultaneously on different parts of the lamp, generated from the units of flashing bulbs concealed within the globe. FIG. 20*c* shows an exploded view of this embodiment, showing the multiple color producing light bulb with a two-piece globe 72*a*, 72*b*, and the attached sleeve 122 which in this case has different light affecting properties on the upper and lower parts of the sleeve. In this case, the upper petal area 122*a* is made totally opaque and reflective on its inner surface; the lower stem area 122*b* partially translucent, but also partially reflective on its inner surface. A wide variety of such novelty bulbs with enveloping globes (for instance, shaped in the form of an elephant or a clown) and appliques of many shapes and light affecting properties, each provided with standard light bulb bases, and installed like a common light bulb, can be made.

An example of apparatus used for multiple color producing floodlights and stagelights is illustrated schematically in FIG. 21*a*, 21*b* and 21*c*. The example uses the elements of this invention and state-of-the-art mirror reflective surfaces 132 to project a plural number of changing colors out some distance from the lamp and onto an object. FIG. 21*a* shows an outer housing 44 with a highly reflective inner surface 132, and an opaque inner reflector 133 with a highly reflective inner surface 132. Also shown are the two colored light generating units 40*a*, 40*b*, in this case color filtered high luminosity projection lamps. FIG. 21*c* illustrates the colored pattern projected 60*a*, 60*b* which could be projected on a wall, a stage or upon any object. The innermost area represents a shadow or image 129 cast by the covering 51, as seen in FIG. 21*b*, concealing the forward colored light generating unit. These projection lamps can also use any manner of refracting lenses to project and focus the beams of light produced by the color generating units. The same principles of the invention can be coupled with stage lights, spotlights, and floodlights that have other prior-art control mechanisms such as panning, tilt, and focus motors and diverse shutters and gates. Control boards, computers, and remote control methods such as audio encoding can be used to determine the timing, the color mixing, and the entire programming of the lamps' function.

FIG. 22*a* shows a hemispherical transparent dome applique 114, that sits over, in this case, the top section 72*a* of a multiple color producing globe with a hole 146 in its top. The applique is pivoted on a pointed rod 126 fastened to the top of the globe over a hole which allows air heated by the enclosed bulbs of the light generating unit 40*a* within the globe to rise and exit the hole, then to pass though a fluted disk 124 attached to the center of the applique 114. As shown in FIG. 22*b*, the air is heated and rises in the dome of the globe and escapes through the hole 146 covered by the fluted disk 124, causing the applique to rotate after a period of time. This method of catching thermal convective currents of air rising from a heat source in the lamps is used as a method of imparting motion to various parts of different embodiments of this invention.

FIGS. 23*a* and 23*b* illustrate one model of a lamp used to form moving images and shadows of various color and shape by some embodiments of the present invention. Discrete images 129 are cast by the use of various motion-effect members 128 such as opaque and transparent objects, and translucid films with images of various light affecting properties placed between some of the light sources in the lamp and a surface on the lamp or an object some distance from the lamp. As the position of the intermittently illuminated light sources of the light generating unit 40*a* shifts, light strikes the motion-effect member 128 at different angles of incidence and casts a differentiated pattern of light images 129 on the object, in this case the translucent screen 46 of the picture box 51 according to the light affecting qualities of the member 128, its shape and its color. The patterns appear to move as they appear in one place then another. Many different embodiments of the present lamps can use this known principle coupled with the other elements of the invention to project moving patterns of colored light and shadow on a wall or ceiling, or on a member of the lamp itself as shown in FIG. 23*a*.

FIG. 24*a* represents a multiple color producing light bulb with a globe of two parts with integrated circuitry means 156 enclosed within the globe envelope, and a multiple-function switch 84 placed on the globe neck. In this case, the upper colored light generating unit 150 is comprised of enclosed steady state colored light bulbs, each a different color and each provided with standard electrical means to place each bulb in electrical communication with the light source timing means, in this case being state-of-the-art electrical circuitry 156. The switch 84 allows the user of the lamp control over several options. One position of the switch will open the circuit to one of the upper enclosed lamps, other positions, lamps of other hues burning one at a time. One of these lamps can be a clear light source. Another switch position will cause more than one of the light sources to be simultaneously illuminated, their colored light blending to form a new resultant light. Another setting of the switch energizes the lower colored light generating unit made up of randomly pulsing colored light bulbs flashed by bimetallic switches within each bulb. FIG. 24*b* shows a multiple light bulb holder 154 with a larger light bulb socket 95 to hold such a lamp as that of FIG. 24*a*. The smaller lower sockets hold and power another colored light generating unit 40.

FIG. 24*c* shows a flower lamp in which such a holder 154 as seen in FIG. 24*b*, can be utilized to hold a multiple color producing light bulb. FIG. 24*c* also illustrates the use of two other types of control switches, in this case being a standard prior-art 3-pole electrical switch 84 which can provide that either of the units 40*a*, 40*b* be energized alone or both simultaneously, and a simple standard prior-art dimmer switch on the cord 86 which provides an option to the user to regulate the rate of pulsation and the intensity of the light sources by increasing or decreasing the amount of power flowing into the lamp.

There are numerous standard ways to cause a light source or a colored light generating unit to pulsate, from timer chips, more or less complicated integrated circuitry, capacitors, various standard flashing receptacles, common disc flashers inserted in light bulb receptacles, and other prior art pulse generators known to those skilled in the art. The bimetallic flashers in the common C-7 and C-9 twinkle Christmas tree bulbs provide a desirable irregular rate of flashing, and is one preferred light source timing means. For more elaborate embodiments, state-of-the-art components can be used to control the length of time the lamps remain "on" and "off". State-of-the-art standard electrical controls can also be used to cause any one color to shine for a selected period of time from each selected generating unit. Various state-of-the-art remote control means and triggers are included in methods of modulation and control that can be used in combination with the claimed elements of this present invention.

FIG. 25 is a schematic diagram illustrating a circuit using an 8 function, double pole analog switch S. A user is enabled thereby to select from several colored lighting effects produced by a two generating unit lamp. The first switch position causes a steady burning red lamp R to shine from the lower generating unit. The second closes the circuit to a yellow Y steady-state lamp. The third position lights the blue lamp B alone, the fourth, the green lamp G. The setting powers a circuit to all of these same lamps but each individual lamp is caused to pulsate at a different rate by the differently rated capacitors $C_1$, $C_2$, $C_3$, $C_4$, the variently lengthed periods of each color resulting in constantly changing permutations of resultant colored light. The sixth setting is here the "off" position. The seventh switch position powers alone the upper color generating unit comprised of five spontaneously pulsing lamps with self-contained circuit breakers. The eighth setting powers both the upper unit and the lower unit operating in its pulsation mode. This circuit includes a fuse F and a dimmer rheostat Re to regulate the intensity and rate of pulsation of any light produced.

FIG. 26 is a schematic diagram of an analog electrical circuit with an 8 function single pole switch S to control the functioning of a single unit multiple color producing light bulb. The user can select which color of light is to be emitted and to optionally choose an irregularly pulsing light of changing colors. This example uses five steady-state lamps, each differently colored W, G, B, Y, R. The first switch setting is the "Off" position. The next four settings light each of the colored lamps individually and the sixth setting powers all the colored lamps, each pulsed at different rates by capacitors C1, C2, C3, C4, each rated differently. The sixth switch position lights a standard clear or "white" lamp.

Again, a wide variety of electrical control switching means can be used to provide a very wide variety of options to users of these lamps, too numerous to describe. The type of current, and voltage and component ratings for these two examples are left unspecified because inumerable variations can be applied.

I claim:

1. An electrical lamp assembly comprised of:

(a) a plurality of colored light generating units each comprised of a plural number of light sources ad coloring means to individually color the light emitted by each light source a desired color, (b) lamp electrical means providing an electrical circuit between an external power supply and each of the light sources to energize said light sources and to make them shine when desired, (c) light source timing means to cause different of the individual said light sources at least some times to shine at least one-at-a-time at different points of time providing that a different color frequency of resultant light can be emitted from individual of said colored light generating units at different times, (d) lamp-part holding means to hold all parts of said lamp assembly together in desired placement, (e) light blocking partitioning means between said colored light generating units to determine an extent of mixing together or blending of the resultant light emitted from individual of said colored tight generating units with the resultant light emitted by the other colored light generating units, (f) a background light affecting area and at least one foreground light affecting area, each of the light affecting areas with a light affecting property selected from a group of light affecting properties including translucent, transparent, opaque, refractive, and reflective, and any degree and combination of these properties, each of the light affecting areas illumined with the resultant light emitted from at least one of said colored light generating units, each of the light affecting areas affecting the resultant light according to said property, (g) a superimposed configuration of the light affecting areas and the colored light generating units, said illumined light affecting areas and said colored light generating units so held by lamp-part holding means that at least some of the light originally emitted by the at lest one colored light generating unit illumining said background light affecting area passes by and around at least part of a periphery of at least one of the illumined foreground light affecting areas superimposed before the illumined background light affecting area, the extent of mixing of the resultant light from the individual colored light generating units determined by said light blocking partitioning means, (h) whereby the lamp assembly can simultaneously illuminate a plural number of light diffusing areas with colored light, each area changing from one color to another.

2. An electrical lamp assembly as set forth in claim 1 wherein said light source timing means provides that for some period of time at least one of said light sources in at least one of said colored light generating units emits a pulsing light pulsing with an alternation of on and off states, providing means that at least one of said colored light generating units can emit a pulsing resultant light at some time.

3. An electrical lamp assembly as set forth in claim 2 wherein said light source timing means provides that at least some time a plural number of the light sources in at least one of said colored light generating units each independently pulsate for randomly varying irregular lengths of time, providing that at least one colored light generating unit can emit at some time an irregularly pulsing resultant light changing hues and shades of color in a random order of appearance and for irregularly changing periods of illumination.

4. An electrical lamp assembly as set forth in claim 1 wherein said background light affecting area is comprised of a light diffusing surface on the interior of a shade membrane, said shade membrane with at least one opening, the shade partially enveloping one of said colored light generating units which illumines at least part of said interior surface, said shade membrane further partially enveloping at least one foreground light affecting area illumined by at least one other of said colored light generating units, said at least one opening allowing at least part of said at least one foreground light affecting area to be seen by a viewer looking through said at least one opening, the at least one illumined foreground light affecting area superimposed before at least part of the illumined light diffusing interior surface of said shade membrane.

5. An electrical lamp assembly as set forth in claim 1 wherein said background light affecting area is comprised of a housing member of at least one piece and with at least one translucent area, said housing member enveloping a plural number of generating units, one being held by lamp-part holding means so that the resultant light it emits shines upon the housing member and through the at least one translucent area, at least one other color generating unit being wrapped around by a substantially opaque membrane with walls that extend substantially to the surface of at least one of said at least one translucent area, said walls limiting the light emitted from the wrapped around generating unit to fall within a prescribed area on the translucent area, said lamp assembly effecting a plural number of glowing areas on said at least one translucent area, at lest part of at least one of the glowing areas on the translucent area encompassed by another glowing area on the translucent area.

6. An electrical lamp assembly as set forth in claim 1 further including a surrounding membrane of at least one piece, at least part of said surrounding membrane being translucent and said surrounding membrane containing said plurality of colored light generating units, said lamp-part holding means holding at least one substantially opaque partitioning member between said colored light generating units, said at least one partitioning member with edges extending far enough towards said surrounding membrane to demarcate a plural number of discrete areas of illumination on the translucent part of said surrounding membrane, said lamp assembly further including a partially enveloping screen which extends sufficiently around said surrounding member to allow at least some of the light passing through said translucent part of said surrounding member to also fall on said partially enveloping screen causing a plural number of discrete areas both on the screen and on the surrounding member to glow with colored light at some time.

7. An electrical lamp assembly as set forth in claim 1 further including an electrically conductive lamp base with electrically insulated opposed contact poles, and wherein said electrical circuit is connected by electrically conducting connection means to the lamp base contact poles, and said lamp assembly further including lamp base attachment means to attach the lamp base to said lamp assembly providing means to hold and power the entire lamp by inserting said electrically conductive lamp base into a powered mating receptacle with electrically insulated opposed contact poles that can make electrical contact with the electrically insulated opposed contact poles on said electrically conductive lamp base.

8. An electrical lamp assembly as set forth in claim 1 wherein at least one of said colored light generating units is provided with an electrical conducting generating unit base with electrically insulated opposed contact poles, and wherein said electrical circuit is connected by generating unit base electrically conducting connection means to the generating base contact poles, and said lamp assembly further including generating unit attachment means to attach said generating unit base to one of said colored light generating units, said lamp assembly providing means to hold and power at least one of said colored light generating units by inserting said generating unit base into a supplied powered mating receptacle with electrically insulated opposed contact poles that can make electrical contact with the electrically insulated opposed contact poles on said generating unit base whereby at least one of the generating units can be easily installed and easily removed from said lamp assembly.

9. An electrical lamp assembly as set forth in claim 1 further including clear light illumination means providing an option to the user of said lamp to radiate a substantially clear or white light from the lamp when desired.

10. An electrical lamp assembly as set forth in claim 1 wherein said background light affecting area and the at least one foreground light affecting area provide light projection means to receive and project at least some of the resultant light emitted by said colored light generating units outward from said lamp assembly some distance onto at least one object located some distance from said lamp assembly, said light sources having sufficient luminosity to illuminate the at least one distant object with a plural number of glowing areas on the at least one distant object.

11. An electrical lamp assembly as set forth in claim 1 further including at least one motion-effect light affecting member with a property selected from the group of light affecting properties including opaque, refracting, reflecting, transparent, translucent, and any degree and combination of these properties, said at least one motion-effect light affecting member held between at least some of said light sources and at least one light affecting object to cause a differentiated pattern of light to fall on said at least one light affecting object, said differentiated pattern differentiated by a perceivable difference in appearance between the pattern of light and an area surrounding the pattern of light, said lamp assembly providing means to produce an apparent effect of movement of said differentiated pattern of light on said light affecting object when the pattern of light appears first in one location and then another resulting from changing angles of incidence of the light emitted from the different positions of said light sources when at least one and then at least one other of the light sources are lighted by said light source timing means at different times.

12. An electrical lamp assembly as set forth in claim 1 further including a heat source which emits sufficient heat to cause a thermal convective airflow within the lamp and said lamp assembly further including a moving part caused to move by said thermal convective air flow.

13. An electrical lamp assembly as set forth in claim 1 further including at least one light bulb lamp comprised of a light bulb lamp envelope and light bulb lamp envelope attachment means to attach said light bulb lamp envelope to an electrically conductive light bulb lamp base with electrically insulated opposed electrical contact poles, said light bulb lamp envelope housing a plurality of enclosed lamps, each of said enclosed lamps each separably operable when powered in an atmospheric environment, said light bulb lamp envelope her housing enclosed lamp coloring means to individually color the light emitted from each of said enclosed lamps a desired color, and said light bulb lamp envelope further housing enclosed lamp holding means to hold said enclosed lamps in desired place within said light bulb lamp envelope, said light bulb lamp envelope with a light affecting property selected from a group of light affecting properties including transparent, opaque, translucent, refracting, and reflecting, and any degree and combination of these properties, said light bulb lamp envelope of at least one piece, said light bulb lamp further including enclosed lamp timing means to energize, at least some times, different individuals of said enclosed lamps at least one-at-a-time at different times, whereby the light bulb lamp can radiate different hoes of colored light at different times, and said electrical lamp assembly further including at least one mating lamp light bulb receptacle into which one of the at least one light bulb lamps can be installed and be powered thereby.

14. An electrical lamp assembly as set forth in claim 1 further including switching control means providing that a user can select a particular desired color to shine from the lamp for a desired length on time by causing said light sources of said particular color to shine at least one at a time in at least one of said color generating units and at other times to cause combinations of the light sources to shine simultaneously in at least one of said color generating units.

15. An electrical lamp assembly as set forth in claim 1 further including at least one multiple bulb holder comprised of:

(a) a receptacle body comprised of an electrically insulative material with a plurality of barrel-like socket cavities, each of said socket cavities having a bottom and sides with light bulb base holding means on said sides to receive and hold a standard light bulb with an electrically conductive standard light bulb base, said standard light bulb base supplied with an electrically insulated side terminal and an electrically insulated bottom terminal, (b) at least one electrically conductive side member embedded within said receptacle body contiguous to said sides of said socket cavities except for a plural number of exposed protrusions of said at least one side member made to protrude into the side of each socket cavity a sufficient distance to provide electrical contact between said exposed protrusions and the side terminals of said standard light bulb bases when said standard light bulbs are installed in said socket cavities, (c) at least one electrically conductive bottom member embedded within said receptacle body contiguous to and under the bottoms of said socket cavities except for a plural number of exposed protrusions of said at least one electrically conductive bottom member made to protrude through the bottom of each of said socket cavities a sufficient distance to provide electrical contact between said exposed protrusions of said at least one electrically conductive bottom member and the bottom terminals of said standard light bulb bases when said standard light bulbs are installed in said socket cavities, (d) multiple bulb holder electrical circuitry means to provide an electrical circuit between said at least one electrically conductive side member, said at least one electrically conductive bottom member, and the outside power supply, (e) multiple bulb holder lamp attachment means to attach said multiple bulb holder to said lamp assembly.

16. A multiple color producing light bulb lamp comprised of a light bulb lamp envelope and light bulb lamp envelope attachment means to attach said light bulb lamp envelope to an electrically conductive light bulb lamp base with electrically insulated opposed electrical contact poles, said light bulb lamp envelope housing a plurality of enclosed lamps, each of said enclosed lamps each separably operable when powered in an atmospheric environment, said light bulb lamp envelope further housing enclosed lamp coloring means to individually color the light emitted from each of said enclosed lamps a desired color, and said light bulb lamp envelope further housing enclosed lamp holding means to hold said enclosed lamps in desired place within said light bulb lamp envelope, said light bulb lamp envelope with a light affecting property selected from a group of light affecting properties including transparent, opaque, translucent, refracting, and reflecting, and any degree and combination of these properties, said light bulb lamp envelope of at least one piece, said light bulb lamp further including enclosed lamp timing means to energize, at least some times, different individuals of said enclosed lamps at least one-at-a-time at different times, whereby the light bulb lamp radiates different hues of colored light at different times when inserted into a powered mating light bulb receptacle socket.

17. A multiple color producing light bulb lamp as set forth in claim 16 wherein enclosed lamp timing means provides that for some period of time at least one of said enclosed lamps emits a pulsing light with an alternation of on and off states.

18. A multiple color producing light bulb lamp as set forth in claim 16 further including envelope access means to allow access to said enclosed bulbs within said light bulb lamp envelope of at least one piece for insertion of said enclosed bulbs and removal of spent enclosed bulbs.

19. A multiple color producing light bulb lamp as set forth in claim 16 further including light bulb multiple function switching means to provide options to a user of the light bulb lamp to select a desired resultant color to shine from the light bulb lamp for a desired period of time by closing and opening the electrical circuitry to at least one of the enclosed light sources at a time.

20. A multiple bulb holder comprised of:

(a) a receptacle body comprised of an electrically insulating material with a plurality of barrel-like socket cavities, each of said socket cavities having a bottom and sides with light bulb base holding means on said sides to receive and hold a standard light bulb with a standard electrically conductive base, the standard base supplied with an electrically insulated side terminal and an electrically insulated bottom terminal, (b) at least one electrically conductive side member embedded within said receptacle body contiguous to said sides of said socket cavities except for a plural number of exposed protrusions of said at least one electrically conductive side member made to protrude into the side of each socket cavity a sufficient distance to provide electrical contact between said exposed protrusions of said at least one electrically conductive side member and said side terminals of said standard light bulb bases when said standard light bulbs are installed in said socket cavities.

(c) at least one electrically conductive bottom member embedded within said receptacle body contiguous to and under the bottoms of said socket cavities except for a plural number of exposed protrusions of said electrically conductive bottom member made to protrude through the bottom of each of said socket cavities a sufficient distance to provide electrical contact between said exposed protrusions of said at least one bottom member and said bottom terminals of said standard light bulb bases when s d standard light bulbs are installed in said socket cavities.

(d) multiple bulb holder electrical circuitry means to connect said at least one electrically conductive side member and said at least one electrically conductive bottom member in an electrical circuit to an outside power supply.

* * * * *